US005335890A

United States Patent [19]

Pryor et al.

[11] Patent Number: 5,335,890

[45] Date of Patent: Aug. 9, 1994

[54] CEILING TRACK MOUNTING APPARATUS

[75] Inventors: John W. Pryor, Oceanside; Jeffery W. Pryor, Vista, both of Calif.

[73] Assignee: Pryor Products, Inc., Oceanside, Calif.

[21] Appl. No.: 995,763

[22] Filed: Dec. 23, 1992

Related U.S. Application Data

[63] Continuation-in-part of Ser. No. 916,468, Jul. 20, 1992, abandoned.

[51] Int. Cl.[5] ..... A47H 1/104

[52] U.S. Cl. ..... 248/343; 16/94 D; 248/228

[58] Field of Search ..... 248/298, 343, 228, 231.6, 248/231.8; 160/196.1, 199; 16/96 R, 96 D, 94 R, 94 D

[56] References Cited

U.S. PATENT DOCUMENTS

| | | | |
|---|---|---|---|
| 656,275 | 8/1900 | Streeter | 248/228 |
| 3,029,055 | 4/1962 | Smith | 248/228 |
| 3,346,909 | 10/1967 | Blackburn | 248/343 |
| 3,431,585 | 3/1969 | Foltz | 16/94 D |
| 4,065,090 | 12/1977 | Mauney | 248/343 |
| 4,102,008 | 7/1978 | Janson | 16/96 R |

OTHER PUBLICATIONS

Acoustical Clip and Spin Nut brochure, Spring Steel Fasteners, 1975, 1 page.

*Primary Examiner*—Richard K. Seidel
*Assistant Examiner*—Hwei-Siu Payer
*Attorney, Agent, or Firm*—Brown, Martin, Haller & McClain

[57] ABSTRACT

An apparatus for installing a cubicle curtain or IV track on a dropped ceiling constructed with standard tee-bars and lay-in tile includes a sliding channel member for sliding engagement over the track, and a clip device secured to the upper wall of the channel member for engaging over a ceiling tee-bar. The channel member can slide along the track and the clip device can slide along the tee-bar for positioning the track, before fastening the track in position. The clip device in one version includes a vertical support for direct attachment to ceiling or roof wires, where additional support is necessary.

8 Claims, 2 Drawing Sheets

CEILING TRACK MOUNTING APPARATUS

CROSS-REFERENCE TO RELATED APPLICATIONS

This application is a Continuation-In-Part of pending application Ser. No. 07/916,468 of the same Applicant, filed Jul. 20, 1992, now abandoned.

BACKGROUND OF THE INVENTION

The invention relates generally to systems for suspending curtain tracks for suspending articles such as cubicle curtains or IV hangers from tile ceilings as are generally used in hospitals, clinics, and other locations where cubicle curtains are used, or for suspending other articles such as lighting fixtures, pictures, plants, kitchen utensils or tools.

In conventional cubicle curtain or IV track installation, extra ceiling wire is installed above the ceiling tiles and support brackets are suspended from this wire to engage over the tee-bars. The track must then be secured to the support brackets by screws. In other arrangements, a carrier channel is suspended in the space above the tile ceiling and the track is secured to the carrier channel by screw fasteners extending through the ceiling tiles. Both of these systems are difficult to install and do not allow for adjustment to match furniture location, for example.

Tracks have also been secured to ceiling tee-bars in the past using snap-on clips which are riveted to the top of the track and snap onto the ceiling tee-bars. Again, these cannot be adjusted later if furniture is relocated or the room is remodelled.

SUMMARY OF THE INVENTION

It is an object of the present invention to provide a new and improved apparatus for installing curtain and IV tracks on tile ceilings.

According to the present invention, an apparatus for securing a track to a tile ceiling comprises a sliding channel member for sliding engagement over a track, the channel member having an upper wall, spaced side walls, and inturned rims at the lower ends of the side walls, a first clip part having a generally U-shaped, inwardly-facing channel along one side edge for clipping over one side edge of a ceiling tee-bar, a fastener securing the first clip part to the upper wall of the channel member, and a second clip part comprising a U-shaped snap fastener for snapping over the opposite side edge of the first clip part and tee-bar to secure the first clip part to the tee-bar.

In the preferred embodiment of the invention, the fastener comprises a swivel connector or rivet for pivotally connecting the first clip part to the channel member so that the track can be positioned at any desired angle to the tee-bar. This arrangement allows the track to be installed without using any tools. The sliding channel member can slide on the track to any desired position. The clip parts can also slide on the tee-bar to adjust the track position. After the track has been positioned in the desired location, it can be secured in place using screw fasteners. If the track needs to be repositioned at a later time due to movement of furniture or remodelling of the room, it can be released and adjusted quickly and easily.

The clip may include a vertical support member for projecting upwardly into the space above a tile ceiling where it can be secured to ceiling wires in a similar manner to the ceiling tee-bar supporting wires. In this way, the track may be independently supported from the ceiling for added strength and stability.

BRIEF DESCRIPTION OF THE DRAWINGS

The present invention will be better understood from the following detailed description of some preferred embodiments of the invention, taken in conjunction with the accompanying drawings in which like reference numerals refer to like parts, and in which.

DESCRIPTION OF THE PREFERRED EMBODIMENTS

Figure 1:
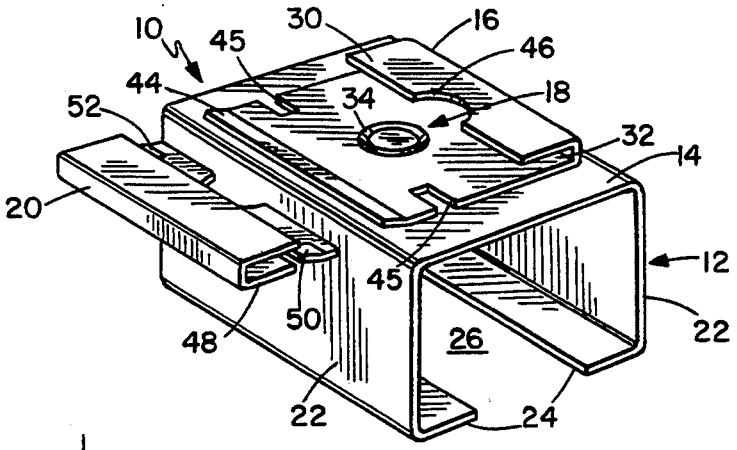
FIG. 1 is an exploded perspective view of a track installation apparatus having separate, snap engageable clip parts according to a first embodiment of the invention.
Figure 2:
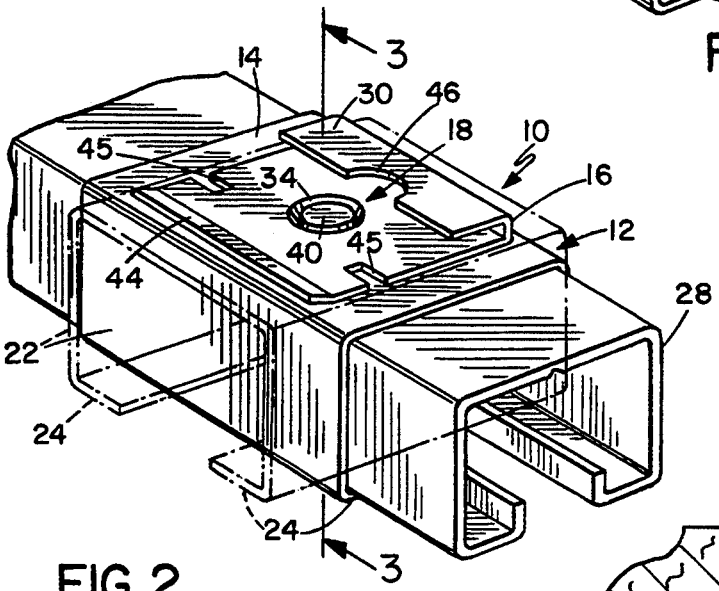
FIG. 2 is a perspective view of one of the clip pairs of the apparatus engaged over a channel track.
Figure 3:
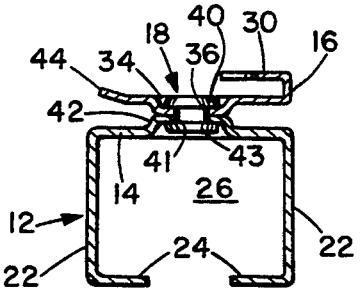
FIG. 3 is a sectional view taken on line 3—3 of FIG. 2.
Figure 4:
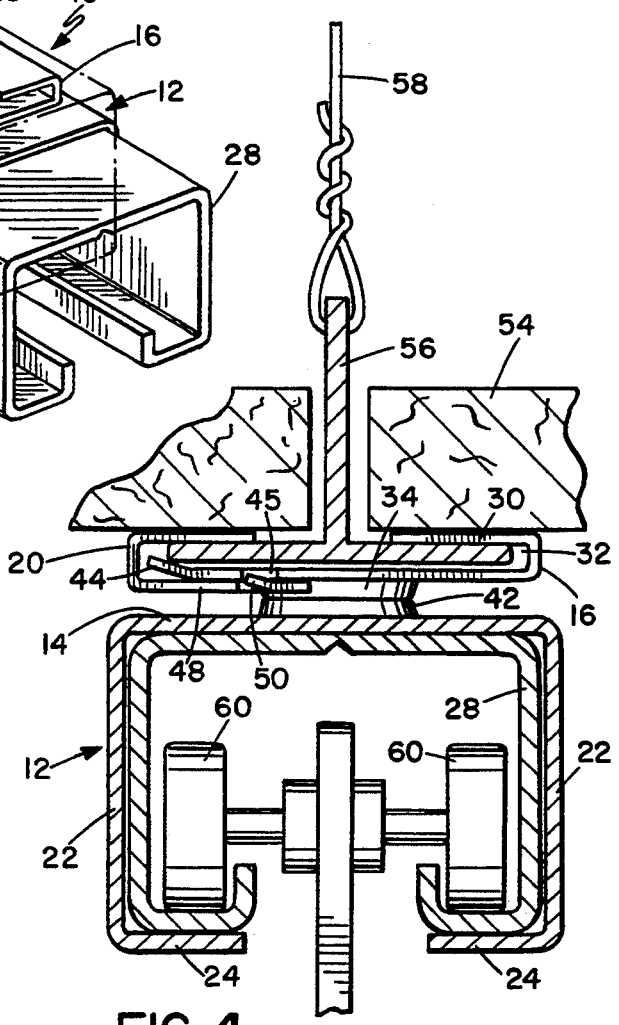
FIG. 4 is an enlarged view showing the attachment of a channel track to a dropped ceiling structure by means of the apparatus.

FIG. 1 of the drawings illustrates a ceiling track installation apparatus 10 according to a first embodiment of the invention with the parts of the apparatus separate prior to installation over a ceiling tee-bar. The apparatus 10 basically comprises a sliding channel member 12 having an upper wall 14 to which a first swivel clip part 16 is rotatably secured via rivet 18, and a second, separate clip part 20 designed for releasable snap engagement with the first clip part, as illustrated in FIG. 4. The sliding channel member 12 has spaced side walls 22 depending downwardly from upper wall 14, and inturned rims 24 projecting inwardly from the lower ends of side walls 22 to define a generally C-shaped, square cross-section channel 26. The channel member is shaped and dimensioned for sliding engagement over a channel track 28 of the type used for suspending cubicle curtains and IV hangers, as best illustrated in FIGS. 2–4.

The first swivel clip part 16 basically comprises a generally rectangular plate member having a first side edge 30 which is bent over to form a generally U-shaped, inwardly-facing channel or groove 32. The part 16 has a recessed central area 34 with a central opening 36 for receiving the shaft of rivet 18 so that head 40 at one end of the rivet 18 is flush with the upper surface of the clip part. The upper wall of channel member 12 has a central opening 41 surrounded by a similar, oppositely-facing recessed area 42 for receiving the head 43 at the opposite end of the rivet, as best illustrated in FIG. 3. Any type of heavy duty rivet may be used for the swivel connection between the channel member and clip part, such as a tubular, machine-installed rivet as illustrated in the drawings. The rivet should have a minimum of 100 lbs. pull-out resistance.

The opposite side edge 44 of the clip part 16 to channel 32 is inclined slightly upwardly. A pair of opposing cut-outs or indents 45 are formed opposite to one another in the other side edges of the part. A central, arcuate cut-out 46 is formed in the bent-over side edge 30.

The second swivel clip part 20 comprises a U-shaped snap member which is illustrated separate from the remainder of the apparatus 10 in FIG. 1 and is designed for snap engagement over the side edge 44 of clip part 16 opposite to channel 32. A bottom leg 48 of the part 20 has a pair of cut-out, upwardly-inclined spring flaps 50, 52 formed adjacent its opposite side edges for snap engagement in the respective indents 45 on opposite sides of the first clip part 16 when the parts are engaged together as illustrated in FIG. 4. The first and second clip parts form a releasable snap-on clip device. Any suitable snap locking member or releasable clip device for engaging the tee-bar may be used. In the preferred embodiment illustrated in the drawings, an Acoustical tile clip manufactured by Thomas Industries, Inc., Lorain, Ohio is used. However, in alternative embodiments, a one-piece clip-on device may be used which can be inserted over the tee-bar and then rotated into an engaged position in which channels in the clip device engage over the opposite side edges of the tee-bar.

The track installation apparatus is designed for installing curtain or IV track on a dropped ceiling structure of tiles 54 held in a frame of tee-bars 56 suspended by wires 58 from a roof support. The apparatus is used to install channel track of the type used for suspending cubicle curtains or IV hangers via rollers 60. The channel member 12 is first slidably engaged over the track, as best illustrated in FIGS. 2 and 3. The track can slide freely through the channel member 12. The track can also be rotated through 360° relative to the first clip part 16 due to the swivel connection between these parts via rivet 18, and FIG. 2 illustrates an adjusted track orientation in dotted outline.

The inturned side edge 30 of the first clip part 16 is then clipped over one side edge of a ceiling tee-bar 56, as illustrated in FIG. 4. The second clip part is snapped over the opposite side edge 44 of the clip part as well as the opposite side edge of the tee-bar, until the spring flaps 50 engage in indents 45, as illustrated in FIG. 4, to releasably secure the assembly to the tee-bar. When the two clip parts are secured together, they define an upwardly-facing, generally C-shaped channel which is shaped and dimensioned for fitting over a standard ceiling tee-bar, as illustrated in FIG. 4, with sufficient free play to allow the clip parts to slide freely along the tee-bar. This arrangement provides universal adjustability in track positioning, since the clip can be positioned anywhere on a tee-bar and the track can be oriented at any desired angle to the tee-bar with the sleeve member positioned at any desired location along the length of the track. The recessed mountings of both heads of the rivet allow the track to slide freely through the sleeve member and also allow the attached clip parts to slide freely along a tee-bar, allowing quick and easy adjustment to the optimum position.

In a ceiling installation, a series of sliding channel members and attached clip parts will be positioned at spaced intervals along the length of the track or rail 28. The spacing is preferably around two feet for a cubicle curtain track and one foot for an IV track. The channel member will slide freely along the track to any desired location, even along bends of up to 18-inch radius in the track. This apparatus allows curtain or IV track to be installed quickly and easily without using any tools, and is adaptable to various different ceiling tee-bar configurations. The track may be used for suspending other articles via suitable hangers, such as lighting fixtures, pictures, plants, kitchen utensils and tools, for example. The apparatus allows for easy modification or relocation of the track in the event of furniture repositioning or room remodelling, without risk of damaging the ceiling or track.

Once the track positioning has been adjusted as desired to match furniture location, it can be secured in place by screw fasteners to prevent lateral movement of the track. This apparatus significantly simplifies and speeds up the installation of curtain track on a dropped ceiling constructed with the standard tee-bars and lay-in tile.

Figure 5:
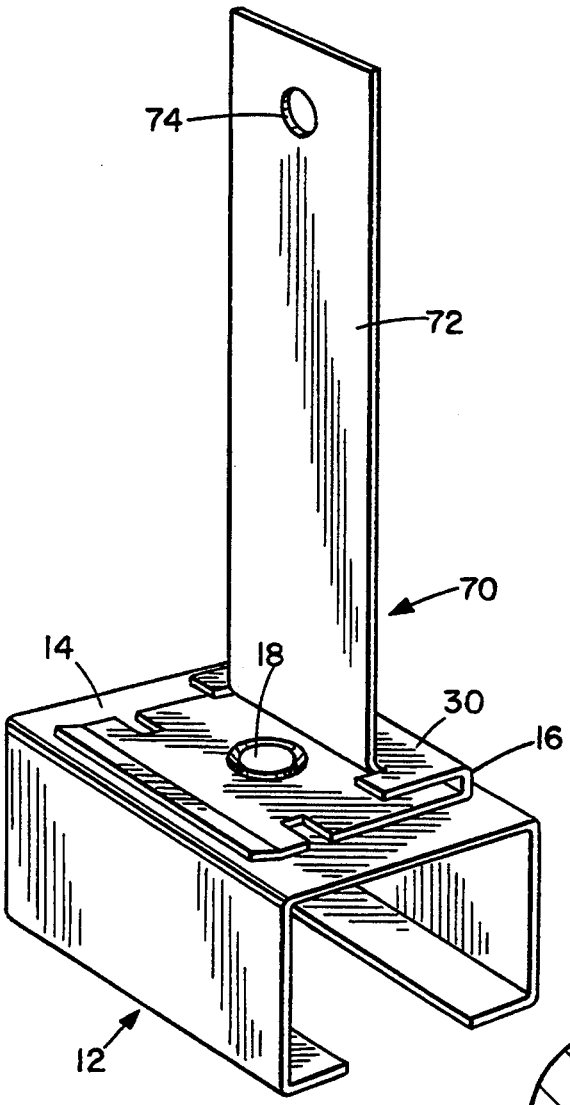
FIG. 5 is a perspective view of an alternative clip configuration with an integral hanger.
Figure 6:
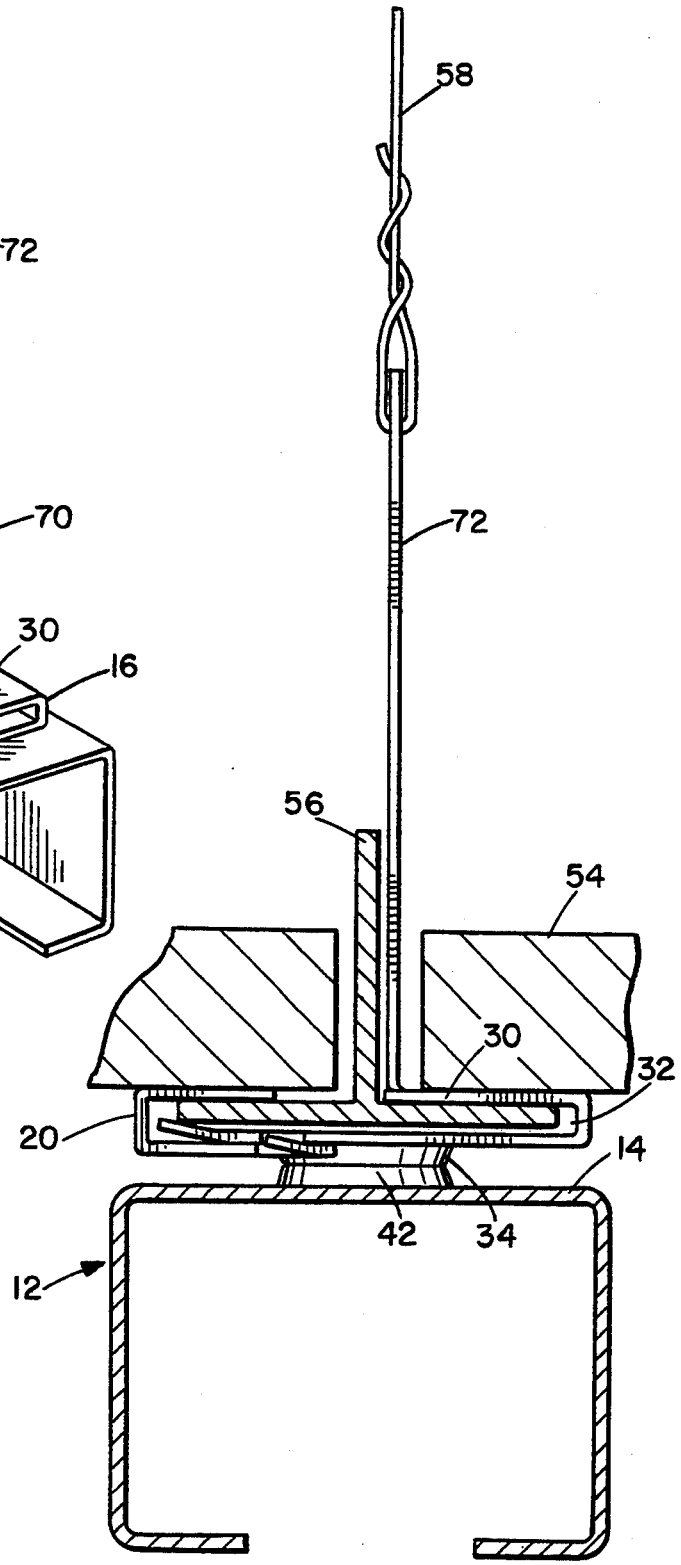
FIG. 6 is a view similar to a portion of FIG. 4, showing the alternative clip arrangement.

FIGS. 5 and 6 illustrate a modified installation apparatus 70 which may be used in applications where independent ceiling support for the track is required, for example in earthquake zones where more rigid building installation restrictions are in force. The apparatus 70 is similar to that of the previous embodiment except that the first clip part 16 has a vertical support bar or member 72 projecting upwardly from end portion 30 for extending through the tile ceiling alongside the vertical support of the tee-bar 56, so that it can be directly secured to a ceiling wire 58 as illustrated in FIG. 6. Apart from this the apparatus is identical to that of the previous embodiment, and like reference numerals have been used where appropriate.

As illustrated in FIGS. 5 and 6, the apparatus 70 basically comprises a sliding channel member 12 through which a track can be installed, as in FIGS. 2 and 4 above, and a two part clip assembly 16, 20 which is riveted to an upper wall 14 of the channel member 12 and can be snap engaged over a ceiling tee-bar 56 as in the previous embodiment. As in the first embodiment, the first clip part 16 comprises a generally flat plate member having a first edge portion 30 which is bent over to form a generally U-shaped inwardly facing channel or groove 32. However, the first clip part also includes the integral, vertical support bar or member 72 which projects vertically upwardly from the free end of edge portion 30 in a plane parallel with the vertical part of the ceiling tee-bar so that it extends upwardly between the ceiling tiles 54 alongside the tee-bar itself. The length of support bar 72 is such that it will extend into the space above the lay-in tile ceiling as well as any insulation. Thus, support bar 72 is longer than the vertical part of the ceiling tee-bar. Bar 72 has an opening 74 at its upper end through which the end of a ceiling wire 58 can be directly tied, as illustrated in FIG. 6. This allows the track to be supported separately from the dropped ceiling tee-bars, and directly from the roof supports, providing a stronger and more stable arrangement.

The ceiling suspended support apparatus 70 may be used alone or in conjunction with the apparatus as in FIGS. 1–4, dependent on the installation requirements. For example, in order to install a particular track, modified clips as in FIGS. 5 and 6 may be directly suspended from ceiling wires at fixed intervals for direct support of the track, and the clips which simply snap onto the tee-bar as in FIGS. 1–4 may be used between the ceiling suspended clips as necessary. Additionally, the apparatus 70 may be used in installing track where there is no dropped tile ceiling, by suspending track directly from the roof structure via wires 58, using no intervening tee-bar structure.

In order to install the ceiling suspended track supporting devices, the ceiling tiles are removed at the appropriate locations and extra ceiling wires 58 are installed at the desired locations by suspension from a suitable roof support. Each clip part 16 is engaged over the side edge of a tee-bar at the selected location and the upper end of the vertical support 72 is secured to the ceiling wire. The mating clip part 20 is then snapped over the opposite edge of clip part 16 and the tee-bar, as illustrated in FIG. 6. This provides a stable and secure mount for ceiling track installations.

Although preferred embodiments of the invention have been described above by way of example only, it will be understood by those skilled in the field that modifications may be made to the disclosed embodiment without departing from the scope of the invention, which is defined by the appended claims.

I claim:

1. An apparatus for suspending a track from a tile ceiling having a series of tiles supported in a grid of tee-bars, comprising:

a sliding channel member comprising means for sliding engagement over the track, the channel member having an upper wall, spaced side walls depending downwardly from the upper wall, and in-turned rims at lower ends of the side walls to define a generally C-shaped channel;

a clip device having means for releasable sliding engagement over a ceiling tee-bar; and a fastener securing the clip device to the upper wall of the channel member, the fastener comprising a swivel connector for pivotally connecting the clip device to the channel-member.

2. The apparatus as claimed in claim 1, wherein the clip device comprises first and second interengageable clip parts, the first clip part comprising a generally flat member having opposite side edges, an inwardly-facing U-shaped channel extending along one side edge of the first clip part for hooking over one side edge of the ceiling tee-bar, and the second clip part comprising means for snap engagement over the opposite side edges of the first clip part and the ceiling tee-bar to releasably secure the first clip part to the tee-bar.

3. The apparatus as claimed in claim 1, wherein the upper wall of the channel member and the clip device have aligned first and second openings, and the swivel connector comprises a rivet having a shaft extending through the aligned openings and a pair of enlarged heads at opposite ends of the shaft.

4. The apparatus as claimed in claim 3, wherein an inner surface of the upper wall of the channel member has a recessed area surrounding the first opening for receiving one of said heads, and the clip device has a recessed area surrounding the second opening for receiving the other of said heads.

5. The apparatus as claimed in claim 1, wherein the clip device has a support bar projecting upwardly in a direction perpendicular to the upper wall of the channel member, the support bar having an opening adjacent its upper end for tying to a ceiling wire.

6. An apparatus for suspending a track from a tile ceiling having a series of tiles supported in a grid of tee-bars, comprising:

a sliding channel member comprising means for sliding engagement over the track, the channel member having an upper wall, spaced side walls depending downwardly from the upper wall, and in-turned rims at lower ends of the side walls to define a generally C-shaped channel;

a first clip part comprising a generally flat member having opposite side edges, one side edge being bent over to form an inwardly-facing U-shaped channel for hooking over a side edge of a ceiling tee-bar;

a swivel connector pivotally securing the first clip part to the upper wall of the channel member; and a second clip part for snap engagement over the opposite side edges of the first clip part and the ceiling tee-bar to releasably secure the first clip part to the tee-bar.

7. An apparatus for suspending a track from a tile ceiling having a series of tiles supported in a grid of tee-bars, comprising:

a sliding channel member comprising means for sliding engagement over the track, the channel member having an upper wall, spaced side walls depending downwardly from the upper wall, and in-turned rims at lower ends of the side walls to define a generally C-shaped channel;

a first clip part comprising a generally flat member having opposite side edges, one side edge being bent over to form an inwardly-facing U-shaped channel for hooking over a side edge of a ceiling tee-bar;

a fastener securing the first clip part to the upper wall of the channel member; and a second clip part for snap engagement over the opposite side edges of the first clip part and the ceiling tee-bar to releasably secure the first clip part to the tee-bar;

the first clip part having a vertical support bar projecting upwardly from said one side edge in a direction perpendicular to the remainder of said first clip part, said support bar having an opening adjacent its upper end and comprising means for extending between ceiling tiles into a space above the tile ceiling for direct suspension from a ceiling wire.

8. A method for installing a track on a dropped ceiling comprising a grid of tee-bars forming tee-bar openings and tile laid into the tee-bar openings, comprising the steps of:

slidably engaging a channel member over the track;

slidably engaging a clip device pivotally secured to an upper face of the channel member over a ceiling tee-bar so that the track can be rotated relative to the tee-bar;

repeating the first two steps to secure a plurality of channel members at spaced intervals to the ceiling tee-bars;

adjusting the position of the channel members on the track and the clip devices on the tee-bars until a chosen track location is reached;

rotating at least some of the channel members relative to the tee-bars to a selected orientation relative to the tee-bars; and securing the track in the chosen location and orientation.

* * * * *